US008368485B2

(12) United States Patent
Brown

(10) Patent No.: US 8,368,485 B2
(45) **Date of Patent: *Feb. 5, 2013**

(54) RADIO FREQUENCY COMBINERS/SPLITTERS

(75) Inventor: Forrest James Brown, Carson City, NV (US)

(73) Assignee: Dockon AG, Zurich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/086,351

(22) Filed: Apr. 13, 2011

(65) Prior Publication Data

US 2011/0187476 A1 Aug. 4, 2011

Related U.S. Application Data

(63) Continuation-in-part of application No. 12/991,387, filed as application No. PCT/GB2009/050579 on May 28, 2009, now Pat. No. 8,040,204.

(30) Foreign Application Priority Data

Jul. 1, 2008 (GB) ..... 0811990.1

(51) Int. Cl.
*H01P 5/16* (2006.01)

(52) U.S. Cl. ..... 333/126; 333/120; 333/129; 333/34

(58) Field of Classification Search ..... 333/100, 333/124–129, 136, 32–35
See application file for complete search history.

(56) References Cited

U.S. PATENT DOCUMENTS 3,815,055 A 6/1974 Plunk et al.
4,490,695 A * 12/1984 de Ronde ..... 333/128
4,968,958 A 11/1990 Hoare
5,075,647 A * 12/1991 Petter ..... 333/121
6,037,911 A 3/2000 Brankovic et al.

FOREIGN PATENT DOCUMENTS

EP 0089083 A 9/1983
EP 0357140 A 3/1990

OTHER PUBLICATIONS

Sakagami et al, "Compact Multi-Way Power Dividers Similar to the Bagley Polygon", 2007, IEEE, pp. 419-422.*
M Villegas et al, "Analysis and design of microwave T-junction circuits for prescribed response characteristics," Proceedings of 36th Midwest Symposium on Circuits and Systems, vol. 1, Aug. 16, 1993, pp. 604-607, XP002539356, Detroit, MI, USA.
Preetham B Kumar et al, "Optimization of Microwave T-junction Power-Divider Circuits," Proceedings of the Midwest Symposium on Circuits and Systems, Lafayette, Aug. 3-5, 1994, New York, IEEE, US, vol. SYMP. 37, Aug. 3, 1994, pp. 1235-1238, XP000531885, ISBN: 978-0-7803-2429-9.

* cited by examiner

*Primary Examiner* — Benny Lee
*Assistant Examiner* — Gerald Stevens
(74) *Attorney, Agent, or Firm* — Woodcock Washburn LLP

(57) ABSTRACT

Embodiments are directed to a RF combiner/splitter having a first port separated from a second port and a third port by a generally tapering microstrip section. The second and third ports are separated by a generally rectangular bridge bar having a width selected to match the impedance of devices to be connected to the second and third ports and a length selected to provide a separation between the second and third ports of approximately quarter wavelength at a center point of an operational frequency of the devices. In a first embodiment, a horizontal RF choke joint is positioned between the first port and the tapering section. In a second embodiment, one choke joint is positioned between the second port and the bridge bar and a second choke joint is positioned between the third port and the bridge bar.

40 Claims, 6 Drawing Sheets

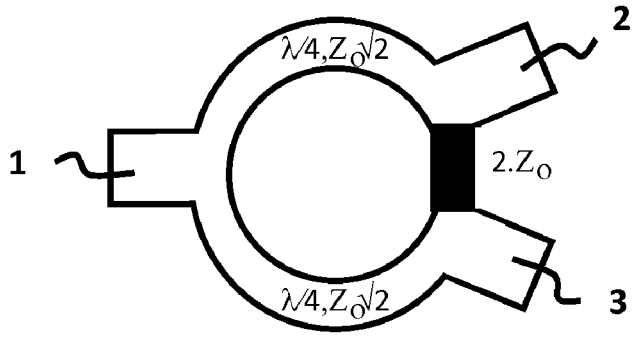
(PRIOR ART) FIG. 1
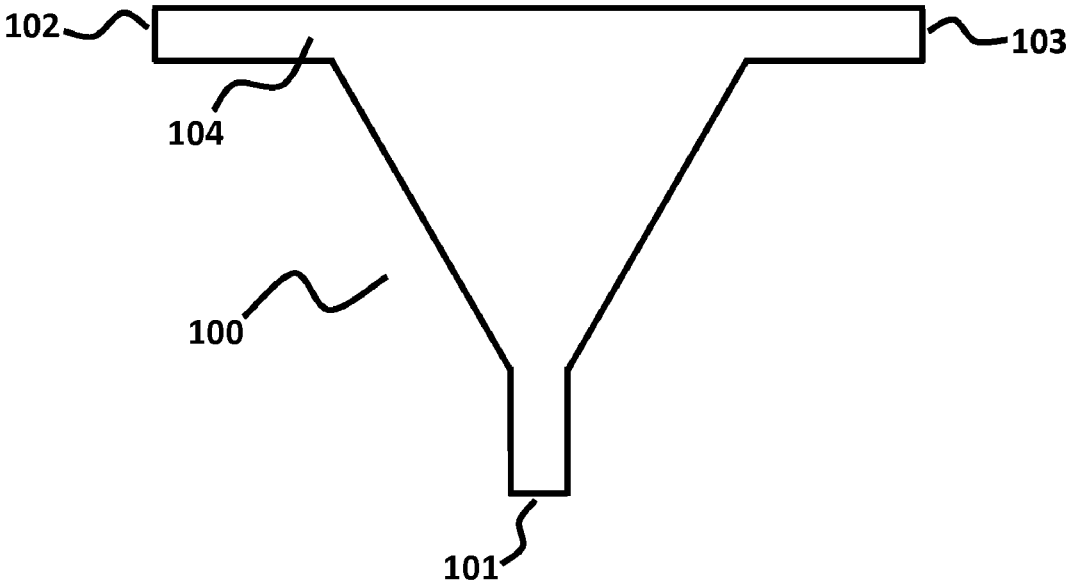
FIG. 2

RADIO FREQUENCY COMBINERS/SPLITTERS

CROSS-REFERENCES TO RELATED APPLICATIONS

This application is a continuation-in-part of U.S. patent application Ser. No. 12/991,387, filed Nov. 5, 2010, which is a national stage application of Patent Cooperation Treaty Serial Number PCT/GB2009/050579, filed May 28, 2009, which claims priority to Patent Application Serial Number GB 0811990.1, filed Jul. 1, 2008.

BRIEF DESCRIPTION OF THE INVENTION

Embodiments are directed to a radio-frequency combiner/splitter having a first port separated from a second port and a third port by a generally tapering microstrip section. The second port and the third port are separated by a generally rectangular bridge bar having a width selected to match the impedance of one or more devices to be connected to the second port and the third port, and a length selected to provide a separation between the second port and the third port of approximately quarter wavelength at a center point of an operational frequency of the devices. In a first embodiment, a horizontal RF choke joint is positioned between the first port and the tapering section. In a second embodiment, a left vertical RF choke joint is positioned between the second port and the bridge bar and a right vertical RF choke joint is positioned between the third port and the bridge bar.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

It is often advantageous to be able to drive more than one transmitting antenna, or to receive a signal from more than one receiving antenna. However, due to problems in impedance mismatch, it is not a simple matter of connecting more than one antenna to the respective input or output of a transceiver. Having more than one receive antenna, for instance, allows a degree of receive diversity to be employed and can increase the received signal strength.

Throughout the specification which follows, reference will be made to splitting or dividing a signal into two or more components, but the skilled person will appreciate that such description also includes combining two or more signals together, since both the prior art described and embodiments of the invention are intrinsically bi-directional.

Prior art techniques for splitting a signal from a single source to feed e.g. a pair of antennas can take a number of different forms. One particular technique uses the well-known Wilkinson Divider. This is shown in FIG. 1. It has the advantage of being relatively cheap, easy to design and implement and offers a predictable and relatively efficient performance at a given frequency. However, since the Wilkinson Divider relies on quarter-wavelength transformer elements, it is frequency dependent and so cannot offer good performance over anything other than a relatively narrow band. This can render it useless for certain wideband (or dual-band) applications.

The Wilkinson Divider of FIG. 1 has three ports labeled 1, 2 and 3. A signal applied to port 1 will be split and emerge as two identical signals from ports 2 and 3. The signal emerging from port 2 and 3 is attenuated by somewhat more than 3 dB compared to the signal input to port 1. In an ideal twin-output divider, the signal from each output port would be 3 dB down on the input signal. In a real Wilkinson Divider, the signal from each output is a little more than 3 dB down, due to losses in the balancing resistor.

Assuming that impedance of the transmitter applied to port 1 is 50 Ohm ($Z_0$), then to ensure maximum power transfer to a pair of 50 Ohm loads, then the impedance at ports 2 and 3 needs to be the same. To ensure this, the path between ports 1 and 2 (and 1 and 3) needs to be a quarter wavelength at the frequency of operation. This sets the characteristic impedance of each branch to be $Z_0\Lambda/2$=70.7 Ohm in this example. The Wilkinson divider requires the use of a balancing resistor between the two branches. This is set to a value of $2Z_0$=100 Ohm. The balance resistor increases the insertion loss of the device, but this is unavoidable in this device. It is desirable to realize the aim of splitting a signal or combining a plurality of signals in a simple manner, without the need for any discrete components, using only microstrip techniques.

BRIEF DESCRIPTION OF THE SEVERAL VIEWS OF THE DRAWING

FIG. 1 shows a prior art Wilkinson Divider in microstrip form;

FIG. 2 shows an embodiment of the present invention;

DETAILED DESCRIPTION OF THE INVENTION

Figure 3:
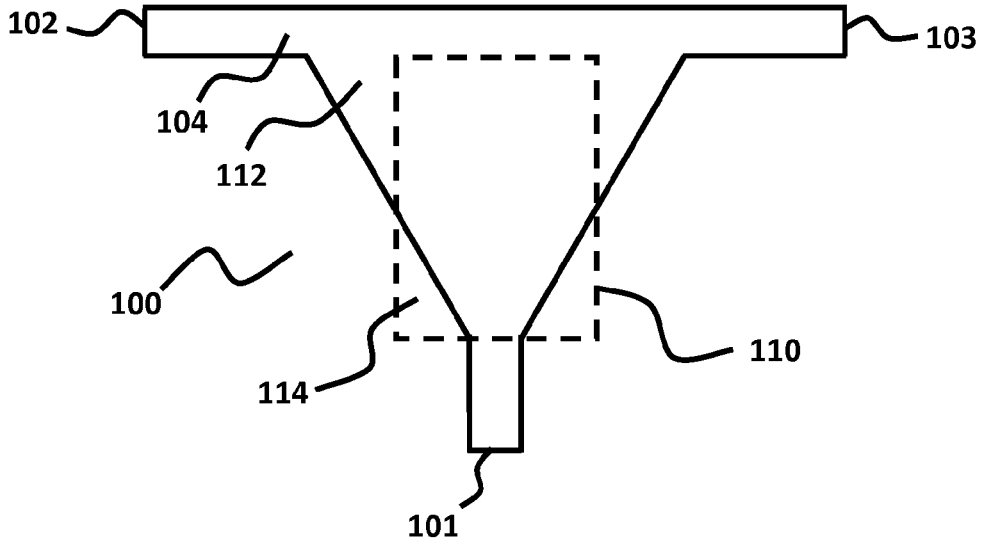
FIG. 3 shows the embodiment of FIG. 2 with some added constructional detail.

Embodiments relate to a multiport splitter (divider) or combiner. It finds particular, but not exclusive, use in allowing a single transceiver to be connected to a plurality of antennas or other devices. In particular, embodiments of the present invention realize the aim of splitting a signal or combining a plurality of signals in a simple manner, without the need for any discrete components, using only microstrip techniques.

FIG. 2 shows an embodiment of the invention constructed using microstrip techniques i.e. the traces are formed by selective removal of metal from a circuit board. The removal can be effected by any suitable means such as etching or laser removal.

The divider 100 of FIG. 2 comprises a first port 101 and two output ports 102, 103. Note that each input port may also be an output port and vice-versa as the divider may also function as a combiner i.e. it is inherently bi-directional.

The input port 101 is located adjacent the vertex of a generally triangular section which tapers outwards to join a generally rectangular section, at whose respective ends are located ports 102, 103. The port 101 is actually at the end of a short, generally rectangular section. The width of this section is determined by the characteristic impedance of the device connected thereto. For instance, if port 101 is to be connected to a device having an impedance of 50 Ohm, then the width of the rectangular section can be calculated accordingly using known techniques and based on the characteristics of the circuit board.

The triangular section joining port 101 to ports 102, 103 serves to provide a generally wideband match between the characteristic impedance of port 101 and ports 102, 103.

In a typical installation, the characteristic impedance of each port will be 50 Ohms. Therefore, the tapering triangular section must match the 50 Ohm impedance of port 101 to an impedance of 25 Ohms formed by ports 102 and 103 being arranged, effectively, in parallel.

The slowly tapering outline of the triangular section serves to provide a slow transition from 50 Ohms at port 101 to 25 Ohms. It also provides isolation of >20 dB between ports 102 and 103.

Ports 102 and 103 are separated by a generally rectangular element 104, herein termed a bridge bar. The dimensions of the bridge bar are selected such that its width (smallest dimension in the plane) is determined by the characteristic impedance of the devices connected to ports 102 and 103. Its length (longest dimension in the plane) is set so that ports 102 and 103 are a quarter wavelength apart at the centre frequency of operation of the divider.

Also, the physical separation between port 101 and 102 and between port 101 and 103 is set to be a quarter of a wavelength at the centre frequency of operation. This structure provides the required isolation between ports.

This can be explained thus: a signal appearing at port 101 which travels to port 102 and is reflected back has had a 90° phase shift on each leg of its journey, meaning that by the time it arrives back at port 101, it is out of phase and so cancels itself out. This is true for all the ports, ensuring that there is good isolation between them all. The tapered section ensures that this isolation is achieved across a wider bandwidth than would be the case if it were absent. In practice, isolation of greater than 30 dB has been measured.

The embodiment of FIG. 2 offers a bandwidth of an octave and a half, and requires no external components to achieve this, making it very simple to implement and cost-effective.

FIG. 3 shows the embodiment of FIG. 2 with some added constructional details to explain how certain of the dimensions of the divider are arrived at. The dotted rectangle 110 has a height equivalent to the tapering section of the triangular portion and a width equivalent to the mean width of the tapering section. If the microstrip construction were adapted such that the tapering section were replaced with the dotted rectangular section, the rectangular section would provide a narrow band match between port 101 and ports 102, 103.

It can be seen that the area of the dotted rectangular section corresponds to the area of the triangular section. Conceptually, it is possible to imagine that the triangular portion 114 is removed from the rectangle 110 and positioned to form triangular portion 112. The same happens on the other side of the triangular portion.

The width of the rectangular portion 110 is determined by the line impedance required to transform the impedance of port 101 into the ports 102 and 103 in parallel.

If all the ports are 50 Ohms, then ports 102 and 103 in parallel will present an impedance of 25 Ohm. This then gives a value for $Z_{width}$ of 35.36 Ohm. From this value of impedance, the width can be directly determined using known techniques.

The tapering shape can then be set, using this value as a mid-point of the section, as described above. The tapering section acts in practice like a series of discrete L-C circuits, which act to provide a wideband match.

If the tapered section is created using linear gradients i.e. the width of the tapered section changes uniformly, then the matching performance is linear. If, however, the tapered section is made non-linear e.g. it has convex, concave or other curved portions, then the matching performance can be made to alter in a non-linear fashion too. For instance, if a device were connected to one of the ports and its characteristic impedance alters with frequency, then the tapered section can be designed to accommodate this and ensure that a good match is achieved at all frequencies of operation.

It can be seen then that an embodiment of the invention can provide a simple, low-cost alternative to the Wilkinson Divider, requiring no external components and offering better power performance (lower insertion loss) over a wider bandwidth. Also, since an embodiment of the present invention requires no matching resistor, there is no corresponding insertion loss, resulting in enhanced power performance.

Figure 4:
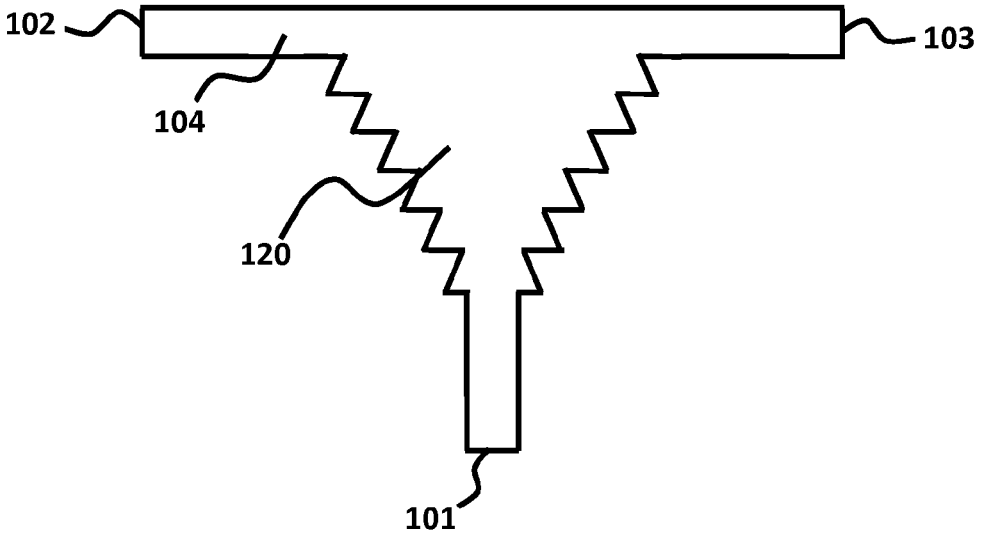
FIG. 4 shows an embodiment of the combiner/splitter with the tapering section having two substantially saw-tooth shaped external edges.

An alternative embodiment of the invention provides a divider operable over an even greater bandwidth, or it can be implemented as a dual-band device. This is shown in FIG. 4. FIG. 4 differs from the device of FIG. 2 in that the tapered section 120 no longer has linear edges. The embodiment shown here follows a generally linear trend, as before, but the outer edges are jagged and comprise a generally saw-tooth or zig-zag structure.

The effect of this is to cause the divider to operate over two discrete frequency bands. The first is determined as before by the characteristic shape of the tapered structure assuming that the jagged edges are not there and the outer edges are smooth, as in FIG. 2. The second band of operation is altered by the presence of the jagged edges, which in microstrip circuits have different reactive qualities. By careful design of the physical layout, using known techniques, the skilled person can design a divider operable over two discrete frequency bands.

Of course, it is possible to design the two frequency bands so that they overlap, offering a device operable over one wider band than is possible using the design of FIG. 2 alone.

Embodiments of the invention find particular use in Radio Frequency (RF) devices operable over at least two bands. It is quite common to offer cellular telephones which operate on at least two bands and by use of an embodiment of the present invention, two different antennas can be provided—one for each band—and they can be connected via a divider to a single radio transceiver.

The frequency of operation of devices according to embodiments of the invention will generally be in the GHz range, and used with wireless telephony and wireless data access devices. Other uses in a range of fields will be apparent to the skilled person.

An embodiment is directed to a radio-frequency divider comprising an input port; two output ports separated by a generally rectangular bridge bar having a width selected to match the impedance of one or more devices to be connected to the two output ports and a length selected to provide a separation between the two output ports of approximately quarter wavelength at a center point of an operational frequency of the devices; and a generally tapering microstrip section having a relatively thinner end and a relatively wider end, the relatively thinner end connected to the input port and the relatively wider end connected along a part of the length of the bridge bar, the generally tapering microstrip section providing a separation between the input port and each of the two output ports of approximately quarter wavelength at the center point.

Yet another embodiment is directed to a radio-frequency combiner comprising an output port; two input ports separated by a generally rectangular bridge bar having a width selected to match the impedance of one or more devices to be connected to the two input ports and a length selected to provide a separation between the two input ports of one quarter wavelength at a center point of an operational frequency of the devices; and a generally tapering microstrip section having a relatively thinner end and a relatively wider end, the relatively thinner end connected to the output port and the relatively wider end connected along a part of the length of the bridge bar, the generally tapering microstrip section providing a separation between the output port and each of the two input ports of approximately quarter wavelength at the center point.

Figure 5:
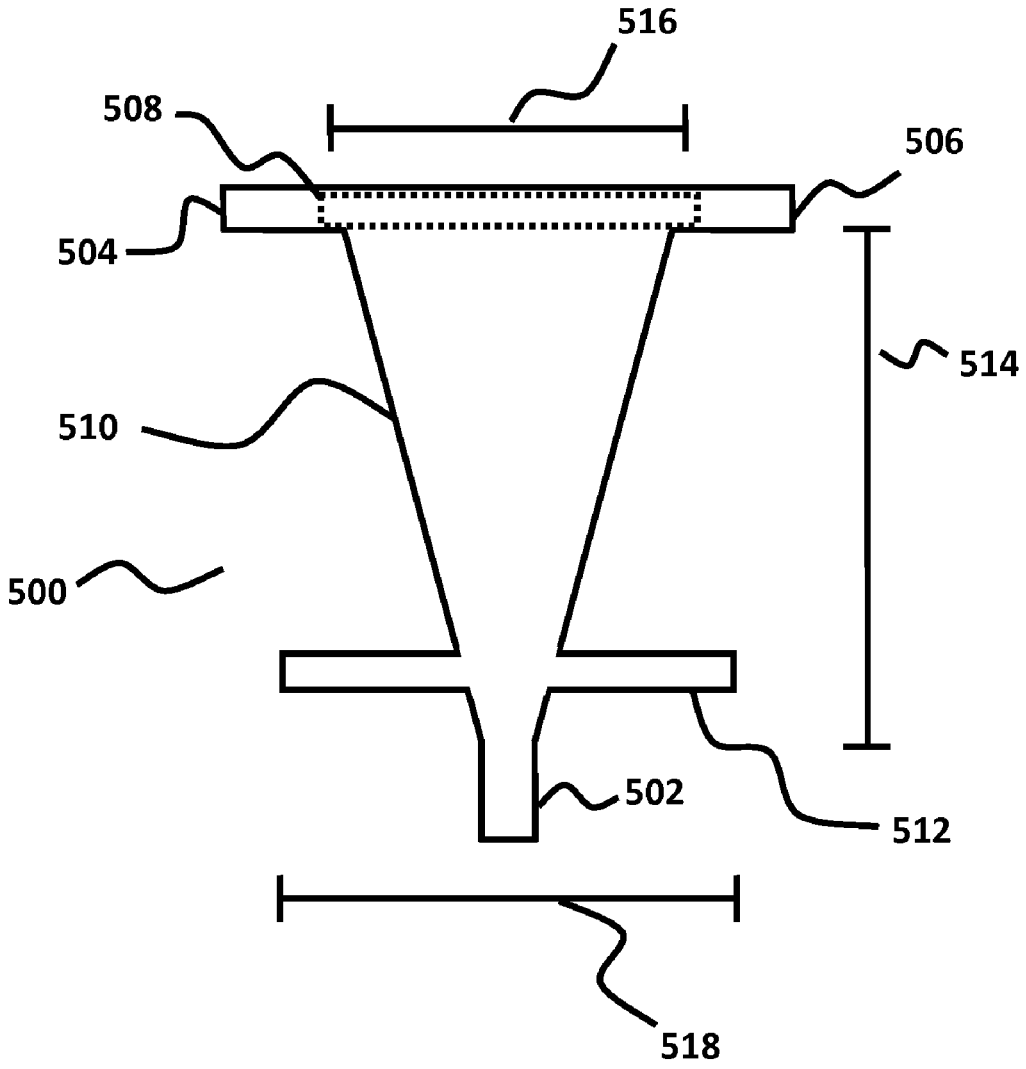
FIG. 5 shows an embodiment of the combiner/splitter with a first choke joint near a first port.

FIG. 5 shows an embodiment of a 900 MHz combiner/splitter 500. The combiner/splitter 500 includes a first port 502, a second port 504, and a third port 506. When the combiner/splitter 500 is being used as a splitter, the signal enters through the first port 502 (the input port), and the signal is divided in two. The first signal output exits via the second port 504 and the second signal output exits via the third port 506. When the combiner/splitter 500 is being used as a combiner, a first signal input enters through the second port 504 and a second signal input enters through the third port 506. The first signal input and the second signal input are then combined into a single signal output that exits the combiner via the first port 502.

The combiner/splitter 500 includes a bridge bar 508, denoted by the dotted line. As submitted above, the tapering triangular section 510 is used to match the 50 Ohm impedance of the first port 502 with the 25 Ohm impedance of the second port 504 and the 25 Ohm impedance of the third port 506. In one embodiment, the width at the top of the tapering triangular section 510 is twice the width at the bottom of the tapering triangular section 510. The actual dimensions of the tapering triangular section 510 affect the geometry of the transition from 50 ohms to 25 ohms. The geometry of the transition has to be exactly balanced in order to achieve the perfect division of power when embodiments are being used as a splitter, and to achieve the perfect combination of power when embodiments are being used as a divider.

The division of power effectively results in the division of impedance. Thus, if power is divided into two signals, then the impedance is divided also by two. The proper way to divide impedance, for example, is by making a taper in the trace from 50 ohms to the new impedance, such as approximately 25 ohms, approximately 33 ohms, etc. As submitted above, a line is drawn through the center of a rectangular transition, and the material removed from the bottom of the rectangular transition is added to the top of the rectangular transition, putting the same angle of the taper back to the top that was removed from the bottom. This results in a tapering triangular section.

Embodiments of the combiner/splitter 500 illustrated in FIG. 5-8, in contrast to the combiner/splitter from FIGS. 2-4, include substantially horizontal choke joints near one or more of the ports that enable the ports be connected to resistive loads, in addition to reactive loads. For example, with respect to FIG. 5, the horizontal choke joint 512 is an RF choke at the center frequency of operation of the combiner/splitter 500. The horizontal choke joint 512 effectively stops the mismatch from the first port to the third port and the mismatch from the first port to the second port from reflecting back into the first port when the first port is connected to a load. The dimensions of the choke joint 512 can be adjusted as necessary to maximize the performance of the combiner/splitter 500. For example, the thinner the choke joint, the narrower the frequency of operation. Conversely, the thicker the choke joint, the wider the frequency of operation. The relationship between the dimensions of the choke joint and the center frequency of operation also applies to embodiments of a combiner/splitter using a left vertical choke joint near the second port and a right vertical choke joint near the third port, further described below, with the dimensions widening or narrowing the frequency of operation.

If the combiner/splitter consisted of a square or rectangular transition instead of a tapering transition, then there would only be one frequency from 50 ohms to 25 ohms for which the combiner/splitter would convert the signal by combining/splitting the signal. In addition, a combiner/splitter with a rectangular transition would have no isolation end to end between the various ports of the combiner/splitter. End to end isolation is necessary for enabling devices connected to the ports of the combiner/splitter to not interfere with each other, while allowing the maximum amount of energy that enters the first port reaching the second port and the third port, and vice-versa, i.e., allowing the maximum amount of energy that enters the second port and the third port reaching the first port. Any other prior art combiner/splitter has a minimum of 3 dB division loss, plus 2 dB connection mismatch loss.

In the combiner/splitter 500, dimension 514 is approximately 6.35 centimeters, dimension 516 is approximately 4.32 centimeters, and dimension 518 is approximately 5.59 centimeters. However, it is noted that the actual dimensions of a combiner/splitter as disclosed herein will be dependent on the center frequency of operation. In addition, a person of ordinary skill in the art can maximize performance of the herein disclosed combiner/splitter by making slight variations to the dimensions of the combiner/splitter.

Figure 6:
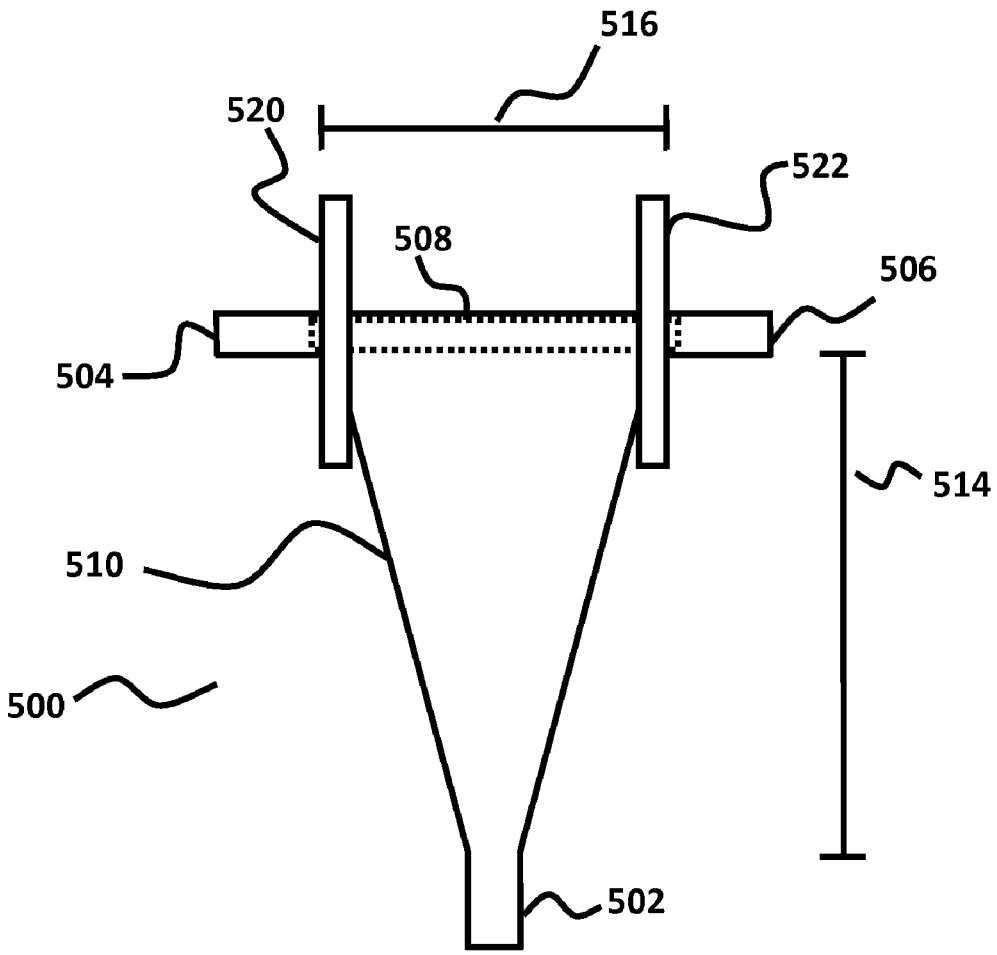
FIG. 6 shows an embodiment of the combiner/splitter of FIG. 5 with a second choke joint near the second port and a third choke joint near the third port.

FIG. 6 illustrates yet another embodiment of a 900 MHz combiner/splitter 520 that uses vertical choke joints 522 and 524 near the second port 504 and the third port 506. In particular, the combiner/splitter 520 uses a left vertical choke joint 522 adjacent the second port 504 and a right vertical choke joint 524 adjacent the third port 506. Further embodiments of the combiner/splitter may use the combination of the vertical choke joints 522 and 524 and the horizontal choke joint 512 within the same combiner/splitter, although such an embodiment is not preferred.

Embodiments of the combiner/splitter without choke joints are appropriate for use in connection with reactive loads, including antennas and devices that behave like antennas, such as transducers. The use of the combiner/splitter with the choke joints enables the combiner/splitter to be used in connection with both reactive loads and resistive loads.

Figure 7:
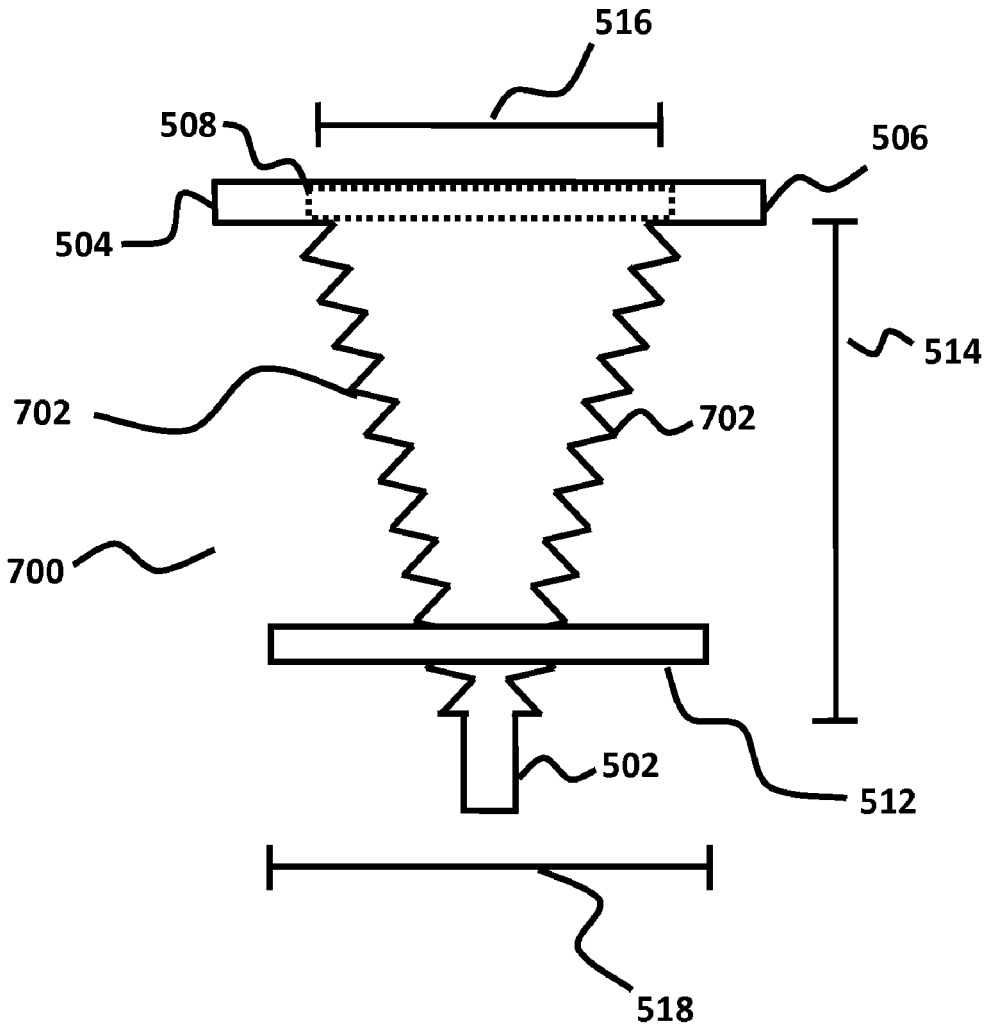
FIG. 7 shows an embodiment with saw-tooth shaped external edges and a first choke joint near a first port.
Figure 8:
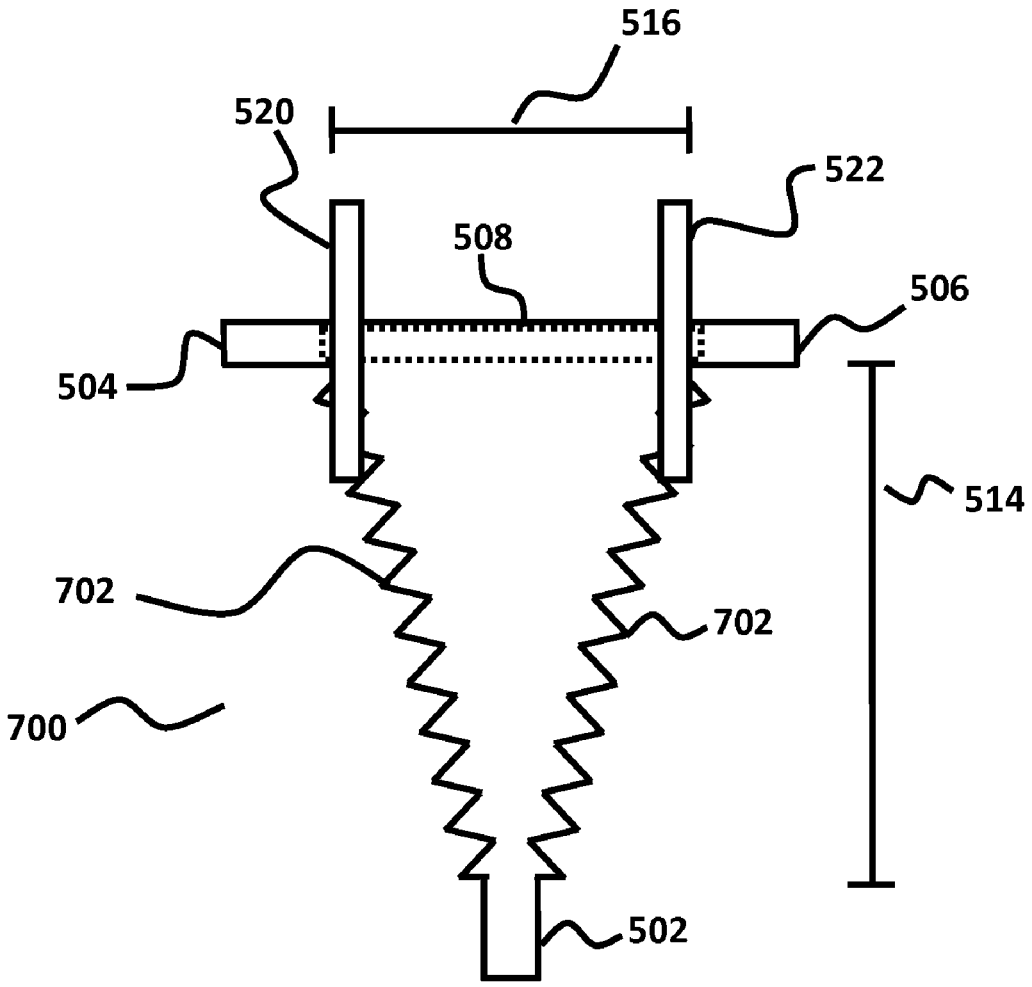
FIG. 8 shows an embodiment with saw-tooth shaped external edges and with a second choke joint near the second port and a third choke joint near the third port.

FIGS. 7 and 8 illustrate yet another embodiment of the 900 MHz combiner/splitter 700 with the triangular section 702 having two substantially saw-tooth shaped 704 edges. FIG. 7 illustrates the combiner/splitter with a single horizontal choke joint 512 near the first port 502. FIG. 8 illustrates the combiner/splitter with the left vertical choke joint 522 near the second port 504 and the right vertical choke joint 524 near the third port 506. As noted above, the zig-zag structure of the edges 704 allows the combiner/splitter to function over a greater bandwidth of frequencies. The dimensions of the linear taper in the combiner/splitter 700 are determined in a manner similar to that described above with respect to the combiner/splitter illustrated in FIGS. 5 and 6, but including the zig-zag for the sides of the tapering section.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

While the present invention has been illustrated and described herein in terms of a various embodiment, it is to be understood that the techniques described herein can have a multitude of additional uses and applications. Accordingly, the invention should not be limited to just the particular description and various drawing figures contained in this specification that merely illustrate a particular embodiment and application of the principles of the invention.

What is claimed is:

1. A radio-frequency divider, comprising:

an input port;

two output ports, separated by a generally rectangular bridge bar having a width selected to match the impedance of one or more devices to be connected to the two output ports and a length selected to provide a separation between the two output ports of approximately one quarter wavelength at a center point of an operational frequency of the one or more devices;

a generally tapering, uniformly filled microstrip section having a relatively thinner end and a relatively wider end, the relatively thinner end connected to the input port and the relatively wider end connected along a part of the length of the bridge bar, the generally tapering microstrip section providing a separation between the input port and each of the two output ports of approximately one quarter wavelength at the center point; and a substantially rectangular input choke joint provides an RF choke at the center point of the operational frequency of the one or more devices, the input choke joint positioned near the input port and the generally tapering microstrip section.

2. The divider as recited in claim 1, wherein a width of the substantially rectangular input choke joint narrows or widens a frequency bandwidth of operation of the divider.

3. The divider as recited in claim 1, wherein the generally tapering microstrip section has two substantially linear shaped external edges.

4. The divider as recited in claim 1, wherein the operational frequency includes a first frequency and a second frequency and wherein the generally tapering microstrip section has two substantially saw-tooth shaped external edges.

5. The divider as recited in claim 4, wherein the first frequency overlaps with the second frequency to create a wide operational frequency.

6. The divider as recited in claim 1, wherein the one or more devices have a characteristic impedance that alters with frequency and wherein the generally tapering microstrip section has two substantially non-linear shaped external edges that ensure a matching impedance to the one or more devices at all frequencies of operation.

7. The divider as recited in claim 1, wherein the generally tapering microstrip section acts as a series of L-C circuits providing a wideband match.

8. The divider as recited in claim 1, wherein the shape of the tapering section is determined based on an impedance matched mid-point of an area represented by the tapering section.

9. The divider as recited in claim 1, wherein the tapering section has an area substantially equivalent to a rectangle having a length the same as a length of the tapering section and a width determined by the line impedance required to transform an impedance of the input port into impedances of the two output ports in parallel.

10. The divider as recited in claim 1, wherein the tapering section has an area substantially equivalent to a rectangle having a length the same as a length of the tapering section and a width determined from a width impedance calculated as a square root of a product of an impedance of the input port and impedances of the two output ports in parallel.

11. A radio-frequency divider, comprising:

an input port;

two output ports, separated by a generally rectangular bridge bar having a width selected to match the impedance of one or more devices to be connected to the two output ports and a length selected to provide a separation between the two output ports of approximately one quarter wavelength at a center point of an operational frequency of the one or more devices;

a generally tapering, uniformly filled microstrip section having a relatively thinner end and a relatively wider end, the relatively thinner end connected to the input port and the relatively wider end connected along a part of the length of the bridge bar, the generally tapering microstrip section providing a separation between the input port and each of the two output ports of approximately one quarter wavelength at the center point;

a substantially rectangular first output choke joint provides an RF choke at the center point of the operational frequency of the one or more devices, the first output choke joint positioned near a first output port among the two output ports and the rectangular bridge bar; and a substantially rectangular second output choke joint provides an RF choke at the center point of the operational frequency of the one or more devices, the second output choke joint positioned near a second output port among the two output ports and the rectangular bridge bar.

12. The divider as recited in claim 11, wherein the generally tapering microstrip section has two substantially linear shaped external edges.

13. The divider as recited in claim 11, wherein the operational frequency includes a first frequency and a second frequency and wherein the generally tapering microstrip section has two substantially saw-tooth shaped external edges.

14. The divider as recited in claim 13, wherein the first frequency overlaps with the second frequency to create a wide operational frequency.

15. The divider as recited in claim 11, wherein the one or more devices have a characteristic impedance that alters with frequency and wherein the generally tapering microstrip section has two substantially non-linear shaped external edges that ensure a matching impedance to the one or more devices at all frequencies of operation.

16. The divider as recited in claim 11, wherein the generally tapering microstrip section acts as a series of L-C circuits providing a wideband match.

17. The divider as recited in claim 11, wherein the shape of the tapering section is determined based on an impedance matched mid-point of an area represented by the tapering section.

18. The divider as recited in claim 11, wherein the tapering section has an area substantially equivalent to a rectangle having a length the same as a length of the tapering section and a width determined by the line impedance required to transform an impedance of the input port into impedances of the two output ports in parallel.

19. The divider as recited in claim 11, wherein the tapering section has an area substantially equivalent to a rectangle having a length the same as a length of the tapering section and a width determined from a width impedance calculated as a square root of a product of an impedance of the input port and impedances of the two output ports in parallel.

20. The divider as recited in claim 11, wherein a width of the first output choke joint and the second output choke joint narrows or widens the operational frequency.

21. A radio-frequency combiner, comprising:

an output port;

two input ports, separated by a generally rectangular bridge bar having a width selected to match the impedance of one or more devices to be connected to the two input ports and a length selected to provide a separation between the two input ports of approximately one quarter wavelength at a center point of an operational frequency of the one or more devices;

a generally tapering, uniformly filled microstrip section having a relatively thinner end and a relatively wider end, the relatively thinner end connected to the output port and the relatively wider end connected along a part of the length of the bridge bar, the generally tapering microstrip section providing a separation between the output port and each of the two input ports of approximately one quarter wavelength at the center point; and a substantially rectangular output choke joint provides an RF choke at the center point of the operational frequency, the output choke joint positioned near the output port and the generally tapering microstrip section.

22. The combiner as recited in claim 21, wherein a width of the output choke joint narrows or widens the operational frequency.

23. The combiner as recited in claim 21, wherein the generally tapering microstrip section has two substantially linear shaped external edges.

24. The combiner as recited in claim 21, wherein the operational frequency includes a first frequency and a second frequency and wherein the generally tapering microstrip section has two substantially saw-tooth shaped external edges.

25. The combiner as recited in claim 24, wherein the first frequency overlaps with the second frequency to create a wide operational frequency.

26. The combiner as recited in claim 21, wherein the one or more devices have a characteristic impedance that alters with frequency and wherein the generally tapering microstrip section has two substantially non-linear shaped external edges that ensure a matching impedance to the one or more devices at all frequencies of operation.

27. The combiner as recited in claim 21, wherein the generally tapering microstrip section acts as a series of L-C circuits providing a wideband match.

28. The combiner as recited in claim 21, wherein the shape of the tapering section is determined based on an impedance matched mid-point of an area represented by the tapering section.

29. The combiner as recited in claim 21, wherein the tapering section has an area substantially equivalent to a rectangle having a length the same as a length of the tapering section and a width determined by the line impedance required to transform an impedance of the output port into impedances of the two input ports in parallel.

30. The combiner as recited in claim 21, wherein the tapering section has an area substantially equivalent to a rectangle having a length the same as a length of the tapering section and a width determined from a width impedance calculated as a square root of a product of an impedance of the output port and impedances of the two input ports in parallel.

31. A radio-frequency combiner, comprising:

an output port;

two input ports, separated by a generally rectangular bridge bar having a width selected to match the impedance of one or more devices to be connected to the two input ports and a length selected to provide a separation between the two input ports of approximately one quarter wavelength at a center point of an operational frequency of the one or more devices;

a generally tapering, uniformly filled microstrip section having a relatively thinner end and a relatively wider end, the relatively thinner end connected to the output port and the relatively wider end connected along a part of the length of the bridge bar, the generally tapering microstrip section providing a separation between the output port and each of the two input ports of approximately one quarter wavelength at the center point;

a substantially rectangular first input choke joint provides an RF choke at the center point of the operational frequency, the first input choke joint positioned near a first input port among the two input ports and the rectangular bridge bar; and a substantially rectangular second input choke joint provides an RF choke at the center point of the operational frequency, the second input choke joint positioned near a second input port among the two input ports and the rectangular bridge bar.

32. The combiner as recited in claim 31, wherein a width of the first input choke joint and the second input choke joint narrows or widens the operational frequency.

33. The combiner as recited in claim 31, wherein the generally tapering microstrip section has two substantially linear shaped external edges.

34. The combiner as recited in claim 31, wherein the operational frequency includes a first frequency and a second frequency and wherein the generally tapering microstrip section has two substantially saw-tooth shaped external edges.

35. The combiner as recited in claim 34, wherein the first frequency overlaps with the second frequency to create a wide operational frequency.

36. The combiner as recited in claim 31, wherein the one or more devices have a characteristic impedance that alters with frequency and wherein the generally tapering microstrip section has two substantially non-linear shaped external edges that ensure a matching impedance to the one or more devices at all frequencies of operation.

37. The combiner as recited in claim 31, wherein the generally tapering microstrip section acts as a series of L-C circuits providing a wideband match.

38. The combiner as recited in claim 31, wherein the shape of the tapering section is determined based on an impedance matched mid-point of an area represented by the tapering section.

39. The combiner as recited in claim 31, wherein the tapering section has an area substantially equivalent to a rectangle having a length the same as a length of the tapering section and a width determined by the line impedance required to transform an impedance of the output port into impedances of the two input ports in parallel.

40. The combiner as recited in claim 31, wherein the tapering section has an area substantially equivalent to a rectangle having a length the same as a length of the tapering section and a width determined from a width impedance calculated as a square root of a product of an impedance of the output port and impedances of the two input ports in parallel.

* * * * *